US007256571B1

(12) United States Patent
Mimberg et al.

(10) Patent No.: US 7,256,571 B1
(45) Date of Patent: Aug. 14, 2007

(54) POWER SUPPLY DYNAMIC SET POINT CIRCUIT

(75) Inventors: Ludger Mimberg, San Jose, CA (US); Hans Wolfgang Schulze, Sunnyvale, CA (US)

(73) Assignee: NVIDIA Corporation, Santa Clara, CA (US)

( * ) Notice: Subject to any disclaimer, the term of this patent is extended or adjusted under 35 U.S.C. 154(b) by 241 days.

(21) Appl. No.: 10/956,258

(22) Filed: Oct. 1, 2004

(51) Int. Cl.
*G05F 1/577* (2006.01)

(52) U.S. Cl. ..... 323/267; 323/268; 323/281

(58) Field of Classification Search ..... 323/265, 323/267, 268, 269, 271, 272, 273, 281, 282, 323/349, 350, 351
See application file for complete search history.

(56) References Cited

U.S. PATENT DOCUMENTS

| | | | | |
|---|---|---|---|---|
| 5,177,431 | A * | 1/1993 | Smith et al. | 323/349 |
| 5,254,878 | A * | 10/1993 | Olsen | 307/75 |
| 5,589,762 | A * | 12/1996 | Iannuzo | 323/351 |
| 5,847,552 | A * | 12/1998 | Brown | 323/281 |
| 5,864,225 | A * | 1/1999 | Bryson | 323/268 |
| 6,369,557 | B1 * | 4/2002 | Agiman | 323/282 |
| 6,456,049 | B2 * | 9/2002 | Tsuji | 323/282 |
| 6,815,938 | B2 * | 11/2004 | Horimoto | 323/282 |
| 6,831,448 | B2 * | 12/2004 | Ishii et al. | 323/282 |

* cited by examiner

*Primary Examiner*—Jeffrey Sterrett

(57) ABSTRACT

A regulator set point circuit. The circuit includes a voltage regulator configured to produce an output voltage. An adjustable voltage source is coupled to the voltage regulator via a feedback circuit, and is configured to generate a voltage adjust signal to control the output voltage.

22 Claims, 4 Drawing Sheets

POWER SUPPLY DYNAMIC SET POINT CIRCUIT

FIELD OF THE INVENTION

The field of the present invention relates to power supplies. More particularly, the present invention relates to a power supply control system.

BACKGROUND OF THE INVENTION

Electronic devices use voltage regulators to condition voltage and current from a power supply to the proper value needed for their internal components. Generally, a voltage regulator for an electronic device comprises a circuit component that is configured to regulate the voltage fed to the other internal components of the device. For example, the power supply in a desktop computer system typically generates power at a number of different voltage levels. The computer system's voltage regulator functions by generating the different voltages used by different components of the device. For example, complex integrated circuits can require several different voltage levels for several different internal components. For example, a microprocessor can require a certain core voltage (e.g., 1.8 volts), which may be different from memory voltage (e.g., 2.0 volts), or I/O voltage (e.g., 3.3 volts).

For example, with integrated circuit electronic devices, as integrated circuits have become more complex, the demands placed upon the voltage regulator systems have become similarly more complex. For example, in addition to requiring several different voltage levels, these voltage levels need to be changed in accordance with the operating modes of the integrated circuit (e.g., full power, sleep mode, standby, etc.). The voltage levels need be precisely maintained at their specified levels in order to ensure the proper function of the integrated circuit. As the levels of integration increase (e.g., over 100 million of transistors on a single die), integrated circuit devices become more sensitive to glitches, surges, drooping, and the like on the voltage supply levels. Additionally, some types of digital integrated circuit devices are prone to large changes in circuit loading, such as, for example, when a user initiates some new application function or some new data must be processed at high clock frequencies.

Also a common problem is the testing of a circuitry for function in all operating conditions. During validation the circuit's voltage will be changed to test the device under test on the high and low borders of the tolerance band of the regulator (shmoo). Some circuits require this test on all units at production test (margining).

Other challenges to the proper functioning of a voltage regulator system involve the distribution of power efficiently to the millions of transistors of the electronic device. Complex electronic devices employ multiple voltage rails that span large areas of the die to deliver power to the various components of the die.

In attempting to address these challenges, some prior art voltage regulators employ sophisticated and comparatively expensive schemes to provide simultaneous set point adjustment for multiple regulators. For example, some prior art schemes are designed to use two input rails only, and cannot use more than two, which limits their flexibility. Similarly, some prior art schemes provide for only one output rail. This is generally due to limitation that in those cases where more than two output phases are needed, the voltages on the input rails cannot be too far removed from one another (e.g., in phase/amplitude) in order for the multiple regulators to function properly. Thus, a new system is required for adjusting set points for one or more regulators at the same time.

SUMMARY OF THE INVENTION

Embodiments of the present invention implement an adjustable power supply voltage regulation system, e.g. for the internal components of an electronic device. Embodiments of the present invention can provide multiple different adjustable voltage levels as required by different internal components/blocks of an electronic device via one or more voltage rails. The voltages provided on the rails are adjusted for the complex relationships created by the loads of the different components of the electronic device.

In one embodiment, the present invention is implemented as a regulator set point adjust circuit for an electronic device. The circuit includes at least two voltage regulators configured to produce a first output voltage and a second output voltage. An adjustable voltage source is coupled to the two voltage regulators via a common feedback circuit, and is configured to generate a voltage adjust signal to simultaneously control the first output voltage and the second output voltage. The adjustable voltage source enables a coordinated adjustment of the first and second output voltages through its operation with the common feedback circuit.

In one embodiment, the circuit includes a single voltage regulator configured to produce the output voltage, which is adjustable in accordance with the voltage to signal.

In one embodiment, the common feedback circuit comprises a first resistor voltage divider coupled to a first voltage regulator and a second resistor voltage divider coupled to a second voltage regulator, wherein the voltage adjust signal is coupled to the first resistor voltage divider and the second resistor voltage divider to simultaneously control the first output voltage and the second output voltage.

In one embodiment, the adjustable voltage source comprises a variable resistor having an adjustable variable resistance configured to produce the voltage adjust signal. In another embodiment, the adjustable voltage source comprises a third resistor voltage divider coupled to a load of the electronic device. This third resistor voltage divider is coupled to the first and second resistor voltage dividers and is configured with a resistor ratio to produce the voltage adjust signal.

BRIEF DESCRIPTION OF THE DRAWINGS

The present invention is illustrated by way of example, and not by way of limitation, in the figures of the accompanying drawings and in which like reference numerals refer to similar elements.

DETAILED DESCRIPTION OF THE INVENTION

Reference will now be made in detail to the preferred embodiments of the present invention, examples of which are illustrated in the accompanying drawings. While the invention will be described in conjunction with the preferred embodiments, it will be understood that they are not intended to limit the invention to these embodiments. On the contrary, the invention is intended to cover alternatives, modifications and equivalents, which may be included within the spirit and scope of the invention as defined by the appended claims. Furthermore, in the following detailed description of embodiments of the present invention, numerous specific details are set forth in order to provide a thorough understanding of the present invention. However, it will be recognized by one of ordinary skill in the art that the present invention may be practiced without these specific details. In other instances, well-known methods, procedures, components, and circuits have not been described in detail as not to unnecessarily obscure aspects of the embodiments of the present invention.

Embodiments of the present invention implement a set point adjusted power supply voltage regulation system. Embodiments of the present invention can provide one or more adjustable voltage levels as required. Embodiments of the present invention and their benefits are further described below.

Figure 1:
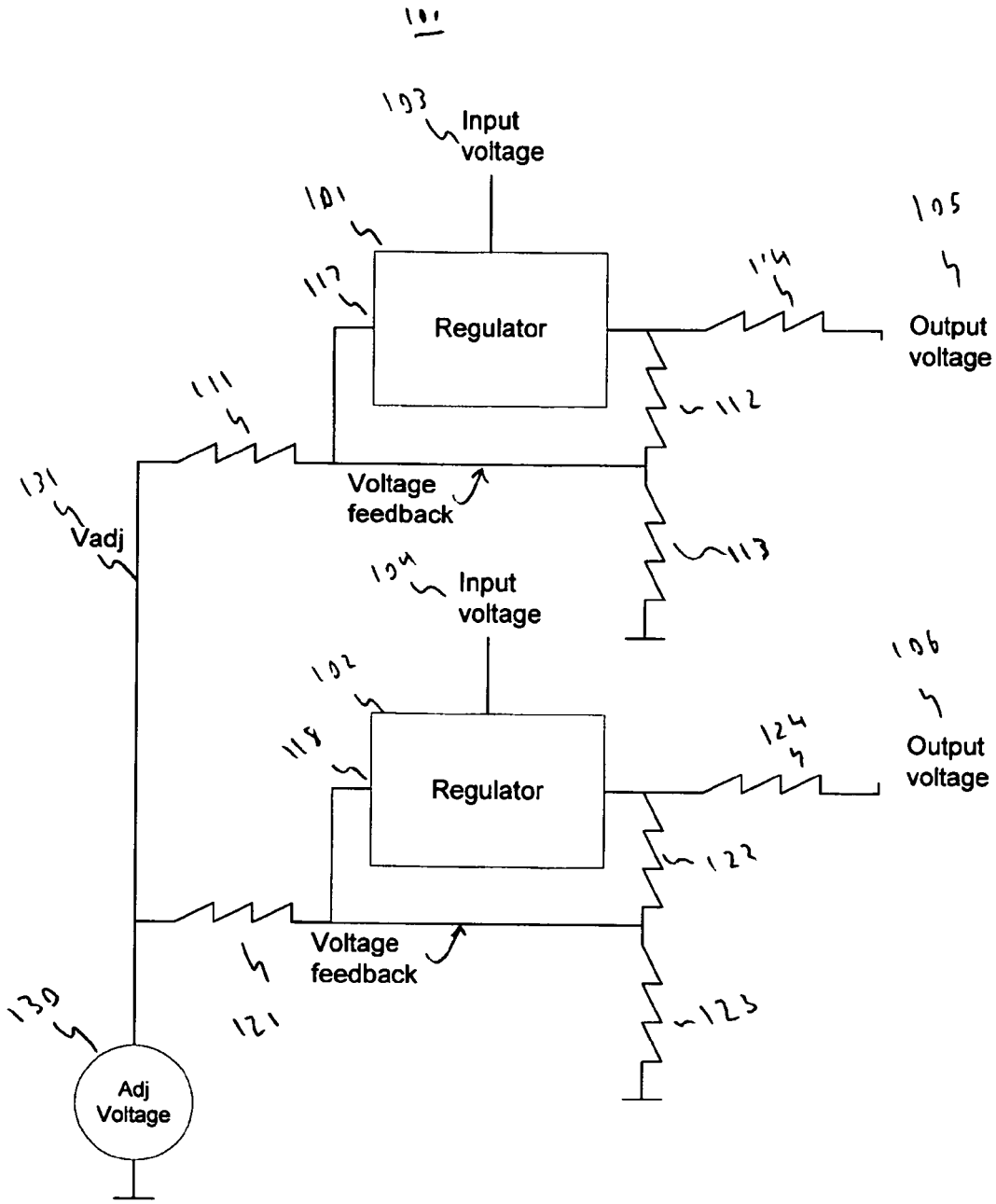
FIG. 1 shows a diagram of a voltage regulator set point circuit in accordance with one embodiment of the present invention.

FIG. 1 shows a diagram of a voltage regulator set point circuit 100 in accordance with one embodiment of the present invention. As depicted in FIG. 1, the circuit 100 includes a first voltage regulator 101 and a second voltage regulator 102. The first and second voltage regulators 101-102 are respectively coupled to receive first and second input voltages 103-104. The voltage regulators 101-102 are configured to produce respective output voltages 105 and 106 as shown.

The output voltages 105-106 are generated in accordance with the requirements of an electronic device. Accordingly, the output voltages 105-106 can be different and are typically coupled to respective voltage rails of an integrated circuit. For example, output voltage 105 can be a power voltage for a core of a processor (e.g. 1.6 volts) while the output voltage 106 can be power voltage for the I/O components of the processor (e.g., 3.3 volts).

An adjustable voltage source 130 is coupled to the two voltage regulators 101-102 via a common feedback circuit. This common feedback circuit includes the resistors 112-113 for the regulator 101 and the resistors 122-123 for the regulator 102. The voltage source 130 produces a voltage adjust signal 131 that influences the voltage provided at the feedback nodes 117-118 of the regulators 101-102.

In the FIG. 1 embodiment, the common feedback circuit further comprises a first resistor voltage divider (e.g., resistors 112-113) coupled to the first voltage regulator 101 and a second resistor voltage divider (e.g., resistors 122-123) coupled to the second voltage regulator. The voltage adjust signal 131 is coupled to the first and second resistor voltage dividers via the tuning resistors 111 and 121.

In the circuit 100 embodiment of FIG. 1, the voltage adjust signal 131 produced by the adjustable voltage source 130 is configured to simultaneously control the first output voltage 105 and the second output voltage 106. The simultaneous control refers to the fact that the voltages 105-106 are adjusted in a coordinated fashion. The coordinated simultaneous control enables a coordinated adjustment of the first and second output voltages 105-106 through the operation with the common feedback circuit. In this manner, the common feedback circuit controls the feedback nodes 117-118 of the regulators 101-102. Based on the value of the adjustable voltage 131, current is either injected into or drained from the feedback nodes 117-118 respectively, thereby setting the output nodes. The first output voltage 105 and the second output voltage 106 are coupled via a of a load of an electronic device (not shown).

In one embodiment, an electronic device incorporating the circuit 100 can have multiple different operating modes requiring respective different operating voltages. Such modes can include, for example, standby, full power, sleep, and the like. As the components of the integrated circuit transition into and out of the modes, the output voltages 105-106 need to be properly adjusted/shifted without causing glitches, droops, or other power integrity problems on the output voltages 105-106.

In one embodiment, the voltage source 130 is an adjustable voltage source that can be controlled in accordance with an input. The ability to control the voltage source 130 in accordance with an input allows logic of an electronic device to determine when the voltage adjust signal 131 should be pushed to a higher voltage level or a lower voltage level.

In one embodiment, the voltage source 130 can be implemented as a digital to analog converter (DAC). The DAC would be configured to receive a digital input signal and convert that signal into a corresponding voltage level (e.g. the voltage adjust signal 131). The digital input signal can be generated by logic of the electronic device. As described above, this input can be used to determine when the voltage adjust signal 131 should be pushed to a higher voltage level or a lower voltage level.

In another embodiment, the voltage source 130 can be implemented as a variable resistor having an adjustable variable resistance. This variable resistance can be used to adjust/control the voltage adjust signal 131. A number of different components can be used to implement the variable resistor. Examples include a multi-tap resistor chain, a potentiometer, and the like.

Figure 2:
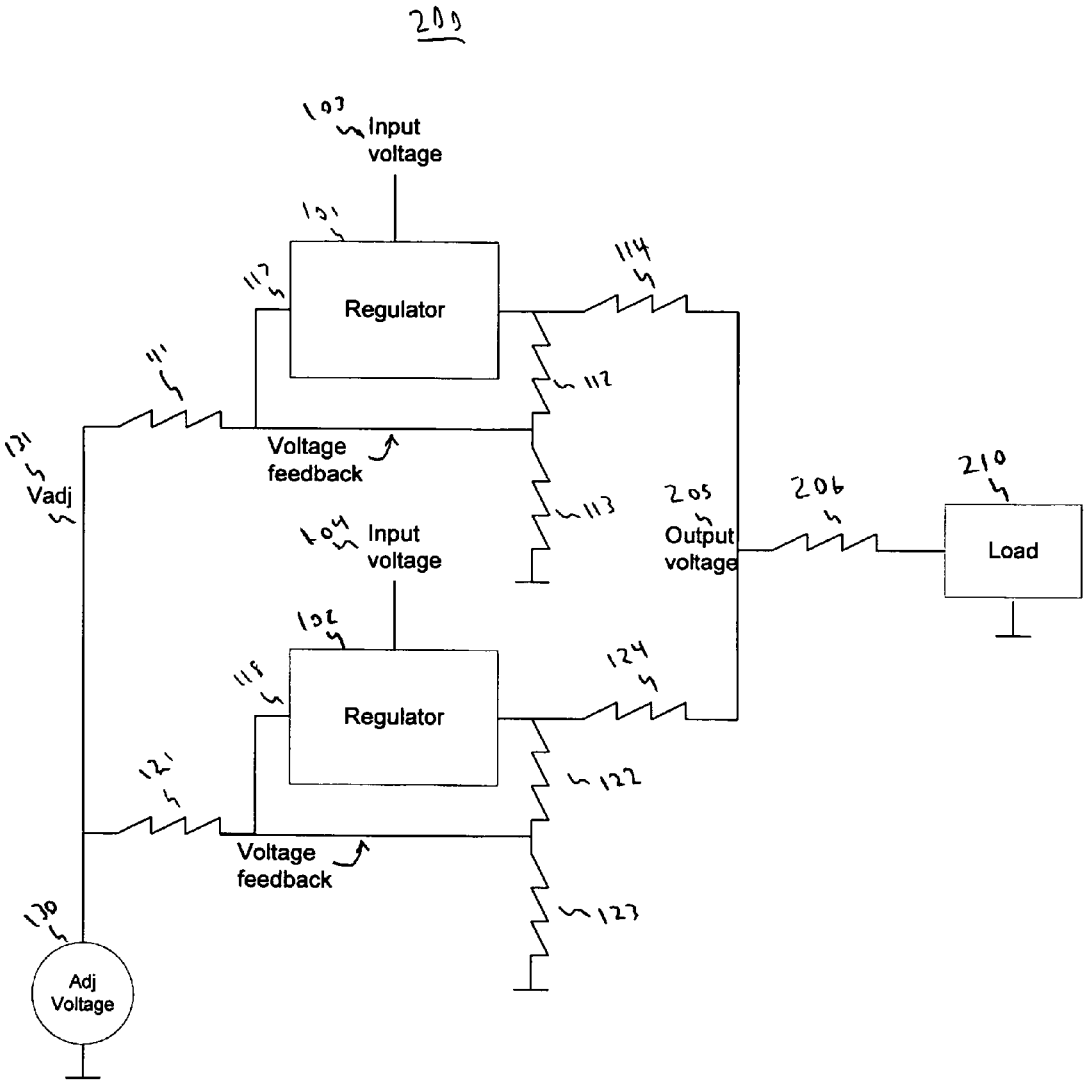
FIG. 2 shows a diagram of a second voltage regulator set point circuit in accordance with one embodiment of the present invention.

FIG. 2 shows a diagram of a second voltage regulator set point circuit 200 in accordance with one embodiment of the present invention. The circuit 200 embodiment shows a common output voltage 205 coupled to a load 210 of the electronic device via a parasitic resistance 206.

In the FIG. 2 embodiment, the outputs of the regulators 101-102 are shown coupled to produce a common output voltage 205. This is the case where, for example, a first output voltage rail and a second output voltage rail are coupled to distribute the first and second output voltages to the electronic device, and where the first and second output voltages are substantially the same. In such a case, the current required to ensure the output voltage 205 remains at its specified level is provided jointly by the regulators 101-102.

It should be noted that the circuit 200 embodiment ensures the regulators 101-102 function together properly without causing interference between their respective output voltages. The configuration of the circuit 200 embodiment prevents voltage errors between the two phases of the regulators' respective outputs. For example, the feedback seen at feedback nodes 117-118 needs to be adjusted, so that the regulators do not fight each other for control of the output voltage 205. For example, prior art multiple regulator systems could not have their feedback nodes directly connected because the feedback between the different phases would not be compensated for. This would result in the regulators pushing or pulling current from one to the other.

To solve this problem, expensive prior art circuits were required (e.g., current share regulators). The circuit 200 embodiment of the present invention employs the resistors 114 and 124. Those will control the power sharing between the two cheap standard regulators used in 101 and 102. The adjustable voltage source 130 in the common feedback circuit allows the shmoo/margining of this circuit 200, that would need the more expensive current share regulator otherwise.

Figure 3:
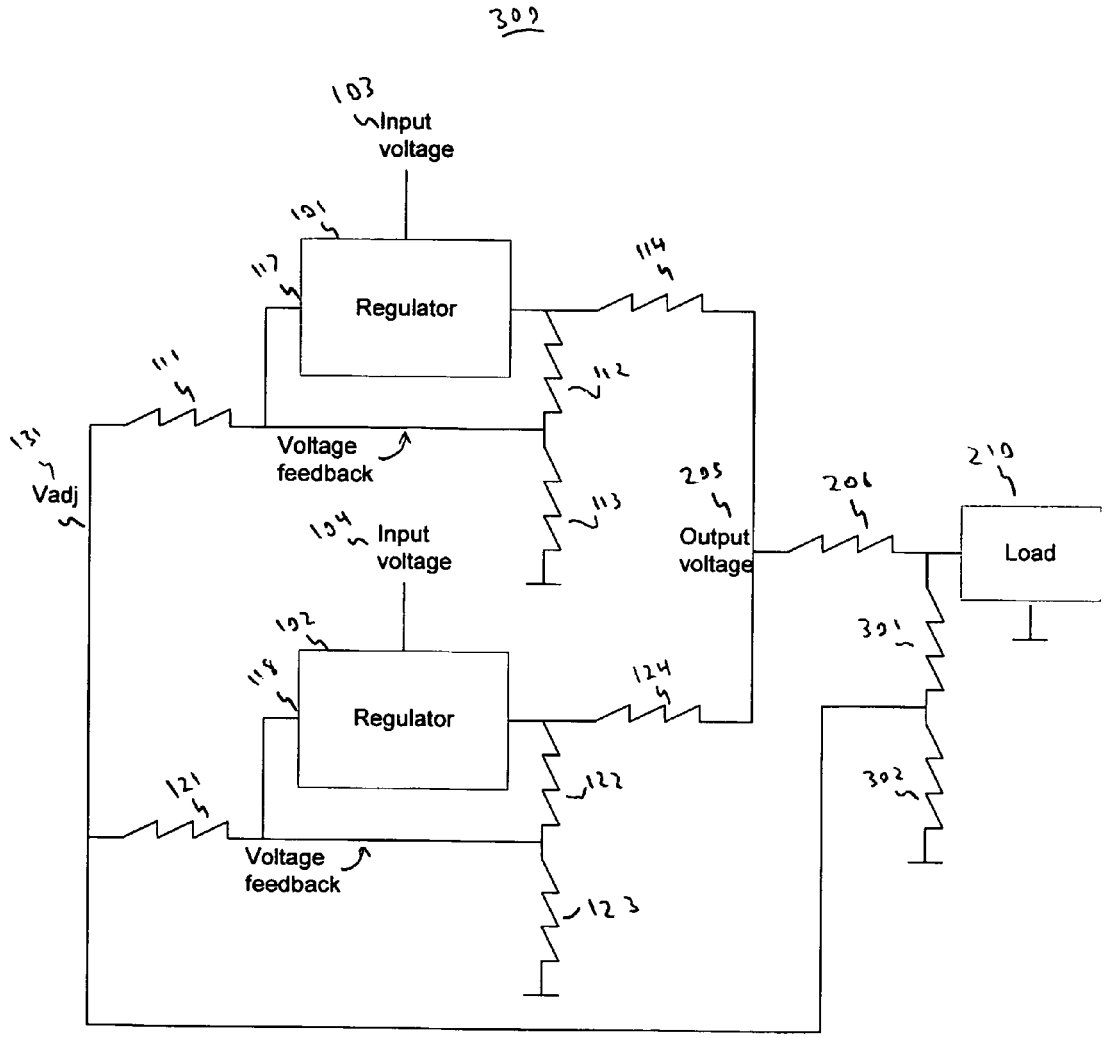
FIG. 3 shows a diagram of a third voltage regulator set point circuit in accordance with one embodiment of the present invention.

FIG. 3 shows a diagram of a third voltage regulator set point circuit 300 in accordance with one embodiment of the present invention. The circuit 300 embodiment shows the common output voltage 205 coupled to the load 210 of the electronic device via the parasitic resistance 206, and a resistor voltage divider (e.g., resistors 301-302) coupled to the load 210 to produce the voltage adjust signal 131.

In the FIG. 3 embodiment, the voltage source is implemented as a third resistor voltage divider (e.g., resistors 301-302). In this embodiment, instead of using a variable or adjustable voltage source, the value of the resistors 301-302 are carefully calibrated during a design stage of electronic device. The sizes of the resistors 301-302 are chosen such that they interact with the first voltage divider (e.g., resistors 112-113) and second voltage divider (e.g., resistors 122-123) through the voltage adjust signal 131 to yield the compensated performance as produced by the circuit 100 embodiment and the circuit 200 embodiment. The circuit 300 embodiment has the advantage of simplicity, in comparison to the circuit 100 and circuit 200 embodiments, in that the need for a variable or adjustable voltage source is eliminated.

Sudden decreases, or droops, in the output voltage levels can be caused by certain components of the integrated circuit suddenly coming under application load (e.g., some new calculation is implemented) as their millions of transistors suddenly start operating at hundreds of megahertz. This loading uses power in "chunks", and ripples back to the regulators 101-102. The resistors 301-302 create now the adjust signal 131 that will compensate the droop over the parasitic connection 206 of the load 210 to the output voltage 205.

Figure 4:
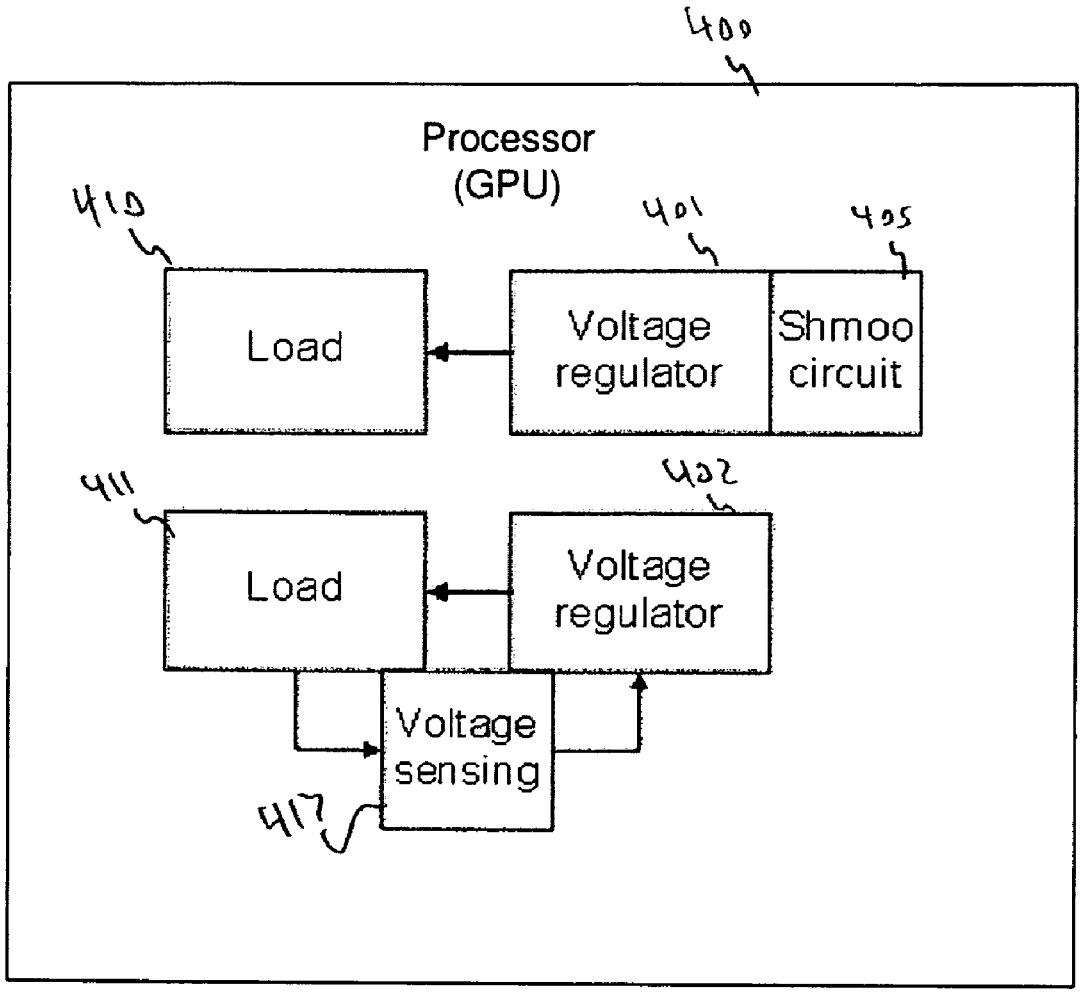
FIG. 4 shows a diagram of an exemplary electronic device incorporating a voltage regulator set point circuit in accordance with one embodiment of the present invention.

FIG. 4 shows a diagram of an exemplary electronic device 400 incorporating a voltage regulator set point circuit in accordance with one embodiment of the present invention. For example, in this case, the electronic device embodiment 400 is a graphics processor unit (GPU) having two load resistances 410 and 411.

In the present embodiment, the load resistances 410-411 are loads for respective subsystems of the GPU 400. The load resistances 410-411 have respective voltage regulators 401-402 coupled to provide respective supply voltages. A "shmoo" circuit 405 is coupled to the voltage regulator 401 to provide specialized testing functionality for the GPU 400. For example, in one embodiment, the shmoo circuit is used to implement a solution space characterization technique useful for device characterization testing. Generally, shmoo testing varies multiple parameters (e.g., supply voltage and operating frequency) and records the results in a format that enables visualization of the interrelationships between control parameters, usually in the form of shmoo plots.

In the GPU 400 embodiment, the voltage sensing circuit 417 provides the feedback and adjustment mechanism enabling the coordinated simultaneous control of the voltage regulators 401 (which could be comprised of a circuit like 300. As described above, a common feedback circuit within the voltage sensing circuit 417 controls the outputs of the regulators 401.

It should be noted that although the voltage regulator set point circuit embodiment of FIG. 4 is described in the context of a GPU, embodiments of the present invention can be implemented as other types of electronic devices. Such devices include, for example, other types of integrated circuits where the loads could be a chip or a part of a chip (e.g., CPU, GPU, DSP, etc.), a larger circuit or a subsystem (e.g., motherboard, graphic card, cell phone, handheld device where the voltage regulator is part of the design) or even a complete system (e.g., a laptop, PC, set top box, gaming console, where the voltage regulator set point circuit is external to the system, as in the case of a "power brick" for a laptop).

The foregoing descriptions of specific embodiments of the present invention have been presented for purposes of illustration and description. They are not intended to be exhaustive or to limit the invention to the precise forms disclosed, and many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated. It is intended that the scope of the invention be defined by the claims appended hereto and their equivalents.

What is claimed is:

1. A regulator set point circuit, comprising:

a plurality of voltage regulators configured to produce a corresponding plurality of output voltages; and an adjustable voltage source coupled to each of the plurality of voltage regulators via a common feedback circuit, and configured to generate a voltage adjust signal to simultaneously control the plurality of output voltages with the feedback circuit.

2. The circuit of claim 1, further comprising:

the adjustable voltage source coupled to each of the plurality of the voltage regulators via a plurality of common feedback circuits, and configured to generate the voltage adjust signal to simultaneously control the plurality of output voltages.

3. A multiple regulator set point circuit, comprising:

a first voltage regulator configured to produce a first output voltage;

a second voltage regulator configured to produce a second output voltage; and a voltage source coupled to the first voltage regulator and the second voltage regulator via a common feedback circuit, and to generate a voltage adjust signal to simultaneously control the first output voltage and the second output voltage.

4. The circuit of claim 3, further comprising:

a first output voltage rail coupled to distribute the first output voltage to an electronic device; and a second output voltage rail coupled to distribute the second output voltage to the electronic device.

5. The circuit of claim 3, wherein the first output voltage and the second output voltage are coupled via a parasitic resistance of a load of an electronic device.

6. The circuit of claim 3, wherein the feedback circuit further comprises:

a first resistor voltage divider coupled to the first voltage regulator; and a second resistor voltage divider coupled to the second voltage regulator, wherein the voltage adjust signal is coupled to the first resistor voltage divider and the second assistant divider to simultaneously control the first output voltage and the second output voltage.

7. The circuit of claim 3, wherein the first output voltage produced by first voltage regulator is different from the second output voltage produced by the second voltage regulator.

8. The circuit of claim 3, wherein the voltage source comprises an adjustable voltage source that can be controlled in accordance with an input.

9. The circuit of claim 3, wherein the voltage source comprises a digital to analog converter configured to generate the voltage adjust signal in accordance with a digital input.

10. The circuit of claim 3, wherein the voltage source comprises a variable resistor having an adjustable variable resistance to produce the voltage adjust signal.

11. The circuit of claim 3, wherein the voltage source is configured to compensate the first voltage output and the second voltage output for glitches caused by a variable load of an electronic device.

12. A multiple power supply set point circuit for producing adjustable output voltages, comprising:

a first voltage regulator configured to produce a first output voltage;

a second voltage regulator configured to produce a second output voltage; and an adjustable voltage source coupled to the first voltage regulator and the second voltage regulator via a common feedback circuit, and to generate a voltage adjust signal to simultaneously control the first output voltage and the second output voltage.

13. The circuit of claim 12, further comprising:

a first output voltage rail coupled to distribute the first output voltage to an electronic device; and a second output voltage rail coupled to distribute the second output voltage to the electronic device; wherein the first output voltage and the second output voltage are coupled via a parasitic resistance and a parasitic capacitance of a load of an electronic device.

14. The circuit of claim 12, wherein the feedback circuit further comprises:

a first resistor voltage divider coupled to the first voltage regulator; and a second resistor voltage divider coupled to the second voltage regulator, wherein the voltage adjust signal is coupled to the first resistor voltage divider and the second assistant divider to simultaneously control the first output voltage and the second output voltage.

15. The circuit of claim 14, wherein the adjustable voltage source comprises a third resistor voltage divider coupled to a load of the electronic device and to produce the voltage adjust signal.

16. The circuit of claim 12, wherein the first output voltage produced by first voltage regulator is different from the second output voltage produced by the second voltage regulator.

17. The circuit of claim 12, wherein the adjustable voltage source comprises a variable resistor having an adjustable variable resistance to produce the voltage adjust signal.

18. The circuit of claim 12, wherein the adjustable voltage source is configured to compensate the first voltage output and the second voltage output for glitches caused by a variable load of an electronic device.

19. An electronic device having a dual regulator output voltage set point circuit for producing adjustable output voltages, comprising:

a first voltage regulator configured to produce a first output voltage;

a second voltage regulator configured to produce a second output voltage;

an adjustable voltage source coupled to the first voltage regulator and the second voltage regulator via a common feedback circuit, and to generate a voltage adjust signal to simultaneously control the first output voltage and the second output voltage;

a first output voltage rail coupled to distribute the first output voltage to the electronic device; and a second output voltage rail coupled to distribute the second output voltage to the electronic device; wherein the first output voltage and the second output voltage are coupled via a load of an electronic device.

20. The electronic device of claim 19, wherein the feedback circuit further comprises:

a first resistor voltage divider coupled to the first voltage regulator; and a second resistor voltage divider coupled to the second voltage regulator, wherein the voltage adjust signal is coupled to the first resistor voltage divider and the second assistant divider to simultaneously control the first output voltage and the second output voltage.

21. The electronic device of claim 19, wherein the adjustable voltage source comprises a third resistor voltage divider coupled to a load of the electronic device and to produce the voltage adjust signal.

22. The electronic device of claim 19, wherein the adjustable voltage source comprises a variable resistor having an adjustable variable resistance configured to produce the voltage adjust signal.

* * * * *